US008811873B2

(12) United States Patent
Kanou

(10) Patent No.: US 8,811,873 B2
(45) Date of Patent: Aug. 19, 2014

(54) FIXING DEVICE HAVING GAP BETWEEN FIXING BELT AND FIXING ROLLER, AND IMAGE FORMING APPARATUS HAVING FIXING DEVICE

(75) Inventor: Hirotaka Kanou, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 59 days.

(21) Appl. No.: 13/478,638

(22) Filed: May 23, 2012

(65) Prior Publication Data

US 2012/0301195 A1 Nov. 29, 2012

(30) Foreign Application Priority Data

May 25, 2011 (JP) ..... 2011-116738

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

2011/0052280 A1* 3/2011 Fujino ..... 399/329

FOREIGN PATENT DOCUMENTS

| | | | |
|---|---|---|---|
| JP | 2005-084095 | A | 3/2005 |
| JP | 2007-286080 | A | 1/2007 |
| JP | 2009-276551 | A | 11/2009 |
| JP | 2009-288578 | A | 12/2009 |

OTHER PUBLICATIONS

Translation of cited document JP2009-276551A; Nov. 26, 2009; to Okuno.*

Office Action (Notice of Grounds of Rejection) issued on Aug. 6, 2013, by the Japanese Patent Office in corresponding Japanese Patent Application No. 2011-116738, and an English Translation of the Office Action. (7 pages).

* cited by examiner

*Primary Examiner* — Quana M Grainger
(74) *Attorney, Agent, or Firm* — Buchanan Ingersoll & Rooney PC

(57) ABSTRACT

A fixing device and an image forming apparatus include, in a fixing nip region, a paper-passage region allowing paper to pass through and a non-paper-passage region located at opposite ends of the paper-passage region and not allowing paper to pass through. The non-paper-passage region is provided with a fixing belt movement restricting member arranged at a prescribed distance away from the fixing belt. Even when the fixing belt comes into abutment with the fixing belt movement restricting member, a prescribed gap is formed between the fixing belt and a surface of the holding member that is opposed to the fixing belt, in the paper-passage region.

12 Claims, 9 Drawing Sheets

FIG.13

| | AMOUNT OF VIBRATION OF FIXING BELT 101(mm) | | ENDURANCE EVALUATION AFTER 3000 TIMES |
|---|---|---|---|
| MATERIAL A | LIGHT PRESSURE-CONTACT | 1.65 | B |
| | PRESSURE-CONTACT | 2.15 | B |
| MATERIAL B | LIGHT PRESSURE-CONTACT | 1.65 | A |
| | PRESSURE-CONTACT | 2.15 | A |
| MATERIAL C | LIGHT PRESSURE-CONTACT | 1.65 | A |
| | PRESSURE-CONTACT | 2.15 | A |

FIXING DEVICE HAVING GAP BETWEEN FIXING BELT AND FIXING ROLLER, AND IMAGE FORMING APPARATUS HAVING FIXING DEVICE

This application is based on Japanese Patent Application No. 2011-116738 filed with the Japan Patent Office on May 25, 2011, the entire content of which is hereby incorporated by reference.

BACKGROUND OF THE INVENTION

1. Field of the Invention

The present invention relates to a fixing device used in a copier, a printer, and a facsimile, a Multi-Functional Peripheral, and so on, and an image forming apparatus. In particular, the present invention relates to a fixing device and an image forming apparatus using induction heating as a heat source in the fixing device.

2. Description of the Related Art

In recent years, there is a growing demand for saving energy and resources in the field of image forming apparatuses. Attention is then focused on fixing devices using induction heating which can achieve high energy efficiency and increase lifetime of image forming apparatuses.

As one of measures for energy saving, a fixing device having a magnetic flux generator mounted on the outside of a belt having a heat generation layer for heating the belt using induction heating has been developed. In addition, in the fixing device adopting induction heating, the material of a fixing roller to be installed is improved so that the durability of the fixing device is improved. Examples of documents disclosing such a fixing device include Japanese Laid-Open Patent Publication Nos. 2005-084095 (Document 1), 2009-276551 (Document 2), and 2009-288578 (Document 3).

In the fixing device disclosed in each document above, a fixing roller having a silicone sponge is inserted in the inside of a fixing belt having a heat generation layer. A durability test conducted on the fixing device having this structure has revealed that the silicone sponge of the fixing roller is thermally degraded and the outer diameter of the fixing roller is thus reduced (shrunken).

It has also been found that when the fixing roller is pressed by a pressing roller and rotated with the hardness of the silicone sponge being reduced, the fixing belt becomes oval, so that vibration of the fixing belt increases during rotation of the fixing belt. As the vibration of the fixing belt increases, the fixing belt comes into contact with that surface of a coil bobbin of the magnetic flux generator which is opposed to the fixing belt, causing damages such as stains and scratches on the fixing belt.

When the fixing belt is damaged, a defect may be produced in an unfixed toner image on a sheet when the sheet passes through a fixing nip region formed by the fixing roller and the pressing roller.

In order to solve the problem above, the distance between the fixing belt and the surface of the coil bobbin that is opposed to the fixing belt may be increased. However, if the distance between the fixing belt and the surface of the coil bobbin that is opposed to the fixing belt is increased, a new problem arises, that is, the heat generation efficiency in induction heating is reduced.

SUMMARY OF THE INVENTION

The present invention is made to solve the problem above. An object of the present invention is to provide a fixing device and an image forming apparatus having a configuration capable of preventing damages to a fixing belt without reducing the heat generation efficiency in induction heating.

A fixing device according to the present invention includes: a fixing belt being driven to rotate and having a heat generation layer generating heat by induction heating; a fixing roller arranged inside the fixing belt; a pressing roller for pressing the fixing belt together with the fixing roller to form a fixing nip region for fixing an unfixed toner image on a sheet passing therethrough; and a magnetic flux generator including a coil for generating a magnetic flux to be passed through the heat generation layer of the fixing belt, and a holding member arranged to be opposed to the fixing belt for holding the coil.

The fixing nip region includes a paper-passage region allowing the sheet to pass through, and a non-paper-passage region located on opposite sides of the paper-passage region and not allowing the sheet to pass through. A fixing belt movement restricting member arranged at a prescribed distance away from the fixing belt is provided in the non-paper-passage region of the holding member. Even when the fixing belt comes into abutment with the fixing belt movement restricting member, a prescribed gap is formed between the fixing belt and a surface of the holding member that is opposed to the fixing belt, in the paper-passage region.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 13 shows a result of rub endurance evaluation of the fixing belt and the fixing belt movement restricting member.

DESCRIPTION OF THE PREFERRED EMBODIMENTS

Figure 1:
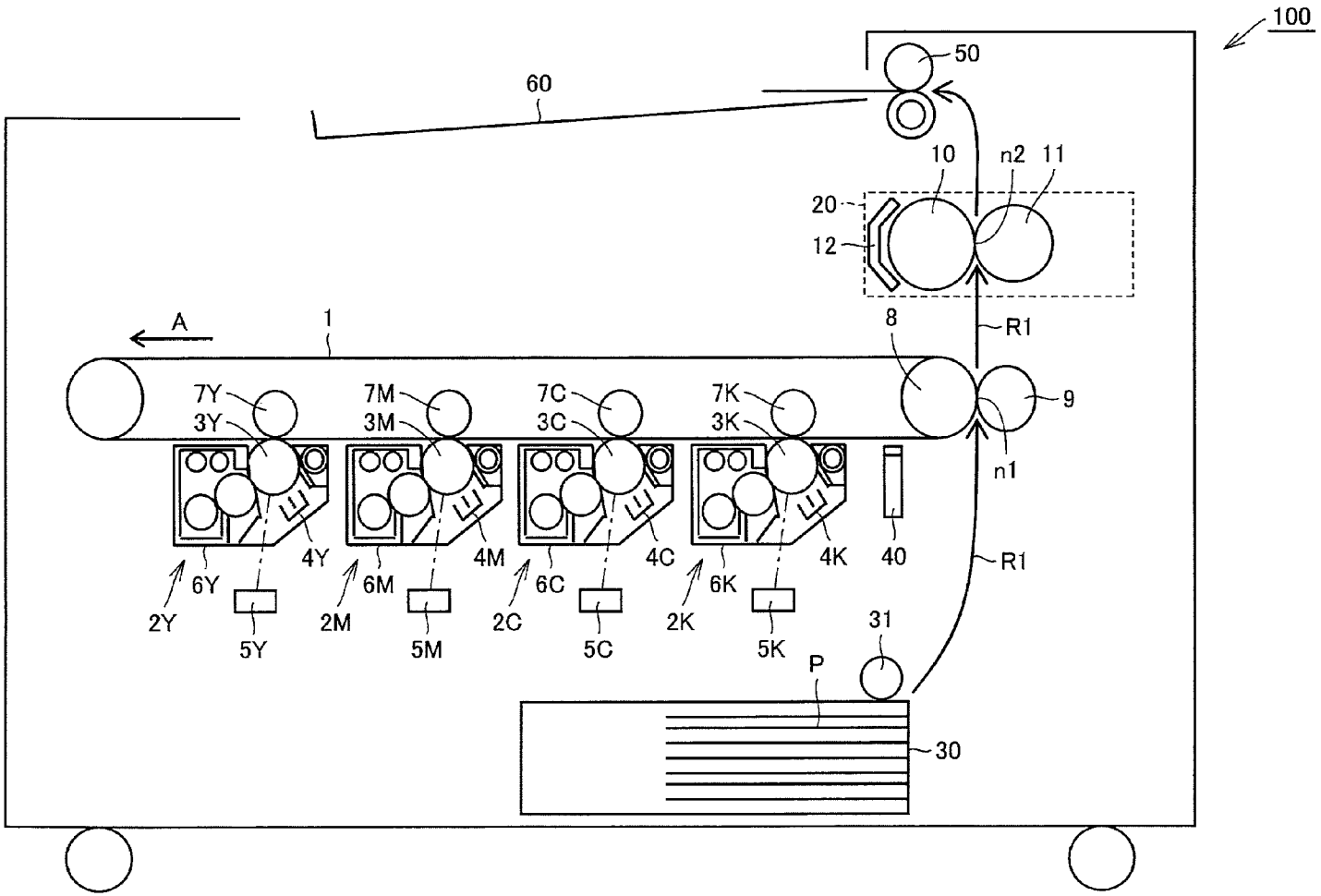
FIG. 1 is a diagram showing an overall configuration of an image forming apparatus (printer) in an embodiment.

A fixing device and an image forming apparatus in embodiments of the present invention will be described below with reference to the drawings. The scope of the invention is not limited to the number and amount referred to in the embodiments described below, unless otherwise specified. The same or corresponding parts are denoted with the same reference numerals, and an overlapping description is not always repeated. It is initially intended to combine the configurations in the embodiments as appropriate.

(Image Forming Apparatus 100)

FIG. 1 shows an image forming apparatus 100 in an embodiment of the present invention. An intermediate transfer belt 1 is provided as a belt member approximately at the center inside image forming apparatus 100. Under a lower horizontal portion of intermediate transfer belt 1, four imaging units 2Y, 2M, 2C, and 2K corresponding to yellow (Y), magenta (M), cyan (C), and black (K), respectively, are arranged side by side along intermediate transfer belt 1 and have photoconductor drums 3Y, 3M, 3C, and 3K, respectively.

Chargers 4Y, 4M, 4C, and 4K, and print head units 5Y, 5M, 5C, and 5K, developing units 6Y, 6M, 6C, and 6K, and primary transfer rollers 7Y, 7M, 7C, and 7K are arranged on the periphery of photoconductor drums 3Y, 3M, 3C, and 3K, respectively, in order along the rotational direction thereof. Primary transfer rollers 7Y, 7M, 7C, and 7K are opposed to photoconductor drums 3Y, 3M, 3C, and 3K, respectively, with intermediate transfer belt 1 interposed therebetween.

A secondary transfer roller 9 is in pressure-contact with that portion of intermediate transfer belt 1 which is supported by an intermediate transfer belt driving roller 8. A nip portion between secondary transfer roller 9 and intermediate transfer belt 1 is a secondary transfer region n1. A fixing device 20 having a fixing roller 10, a pressing roller 11, and a magnetic flux generator 12 is arranged on a conveyance path R1 downstream from secondary transfer region n1. A pressure-contact portion between fixing roller 10 and pressing roller 11 is a fixing nip region n2.

A paper-feed cassette 30 is removably disposed at a lower portion of image forming apparatus 100. With rotation of a paper-feed roller 31, paper P loaded and accommodated in paper-feed cassette 30 is passed onto the conveyance path R1 one by one in order from the top. An AIDC (Auto Image Density Control) sensor 40 also serving as a resist sensor is installed between secondary transfer region n1 and imaging unit 2K which is the most downstream on intermediate transfer belt 1.

(General Operation of Image Forming Apparatus 100)

A general operation of image forming apparatus 100 having the configuration described above will now be described. When an image signal is input from an external device (for example, a personal computer) to an image signal processing unit (not shown) of image forming apparatus 100, the image signal processing unit generates a digital image signal by converting the image signal into yellow, cyan, magenta, and black and allows print head units 5Y, 5M, 5C, and 5K of imaging units 2Y, 2M, 2C, and 2K to emit light for exposure based on the input digital signal.

Electrostatic latent images formed on photoconductor drums 3Y, 3M, 3C, and 3K are developed by developing units 6Y, 6M, 6C, and 6K, respectively, to form color toner images. The color toner images are successively superimposed and primarily transferred onto intermediate transfer belt 1 moving in the direction shown by an arrow A in FIG. 1 by the action of primary transfer rollers 7Y, 7M, 7C, and 7K.

The toner image formed on intermediate transfer belt 1 in this manner reaches the secondary transfer region n1 with the movement of intermediate transfer belt 1. At the secondary transfer region n1, the superimposed color toner images are secondarily transferred collectively onto paper P by the action of secondary transfer roller 9.

(Fixing Device 20)

Figure 2:
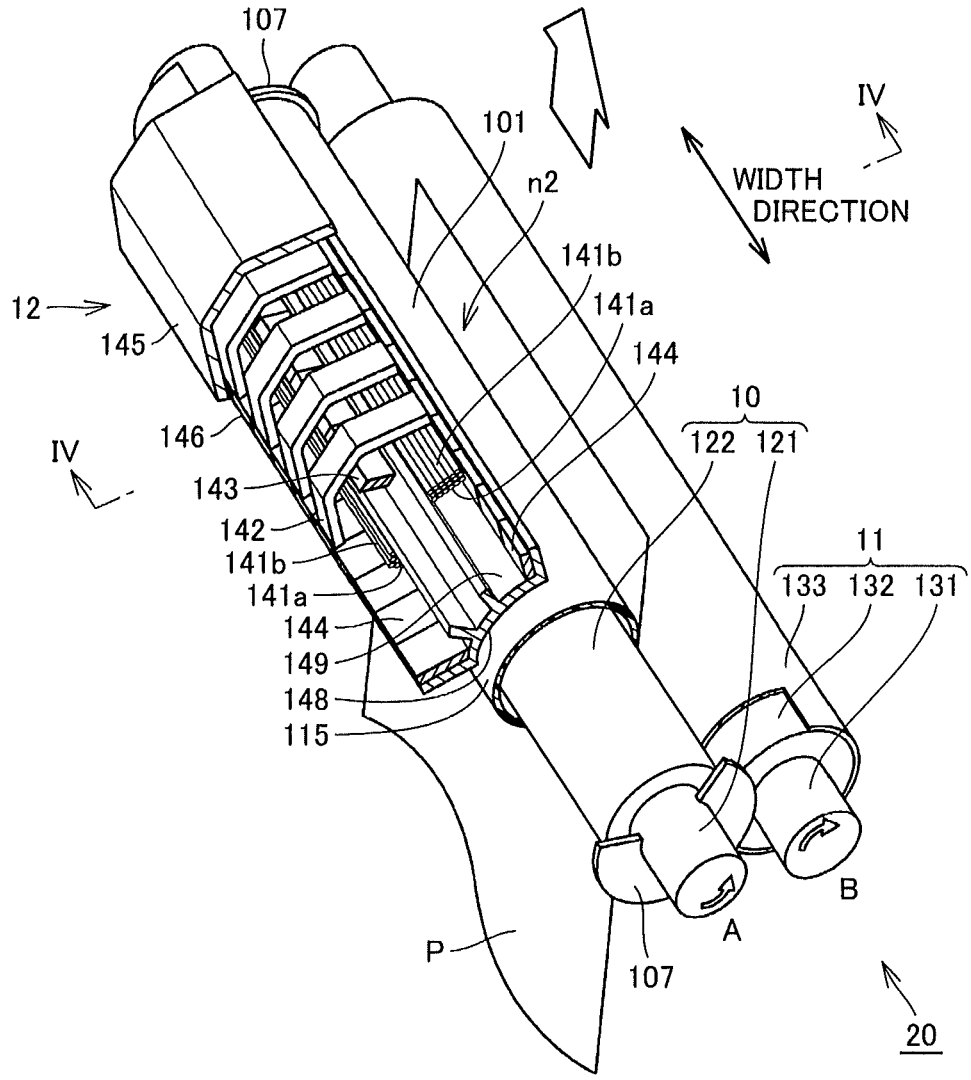
FIG. 2 is a partially exploded perspective view showing a configuration of a fixing device adopted in the image forming apparatus in the embodiment.
Figure 3:
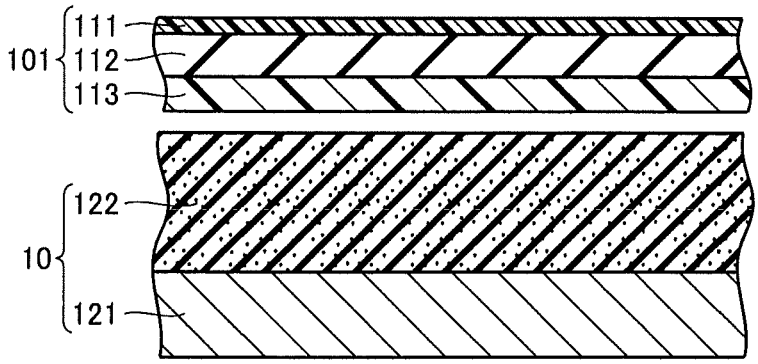
FIG. 3 is a cross-sectional view of a fixing belt and a fixing roller of the fixing device in the embodiment.

Referring now to FIG. 2 and FIG. 3, fixing device 20 will be described. The toner image secondarily transferred on paper P reaches fixing nip region n2 of fixing device 20. At fixing nip region n2, the toner image is fixed on paper P by the action of pressing roller 11 and fixing roller 10 induction-heated by magnetic flux generator 12 included in fixing device 20. Paper P having the toner image fixed thereon is discharged to an output tray 60 through an exit roller 50.

Fixing device 20 includes fixing belt 101, fixing roller 10, pressing roller 11, and magnetic flux generator 12. Fixing belt 101 is a cylindrical belt driven to rotate in the direction of the arrow A in FIG. 2.

(Fixing Belt 101)

Fixing belt 101 has an inner diameter of about 40 mm. An elastic belt that is self-standing and can hold a generally cylindrical shape by itself is used. The length in the belt width direction (corresponding to the rotational axis direction of fixing roller 10) of fixing belt 101 is longer than the length in the width direction of the maximum size sheet. FIG. 2 shows that paper P smaller than the maximum size is passing through fixing nip region n2.

As shown in FIG. 3, fixing belt 101 is formed such that a release layer 111, an elastic layer 112, and a heat generation layer 113 are stacked in this order, in which release layer 111 is on the front surface side. Release layer 111 is formed of PFA (tetrafluoroethylene-perfluoroalkyl vinylether copolymer) or the like having a thickness of about 20 μmm. Elastic layer 112 is formed of silicone rubber or the like having a thickness of about 200 μm. Heat generation layer 113 is formed of nickel or the like having a thickness of about 10 μM and generates heat by a magnetic flux produced from magnetic flux generator 12.

(Fixing Roller 10)

As shown in FIG. 2 and FIG. 3, fixing roller 10 has a heat insulation layer 122 stacked on the periphery of a long cylindrical core metal 121 and is disposed in the inside of the rotational path of fixing belt 101 (the rotational travel path). Core metal 121 is made of aluminum, stainless steel, or the like. Heat insulation layer 122 is formed of silicone sponge rubber or the like. The outer diameter of fixing roller 10 is about 40 mm or less. Disc-shaped members 107 are fitted on the outside of the opposite ends of core metal 121 in order to prevent fixing belt 101 from displacing in the belt width direction.

(Pressing Roller 11)

As shown in FIG. 2, pressing roller 11 has a release layer 133 stacked on the periphery of a long cylindrical core metal 131 with an elastic layer 132 interposed therebetween. Pressing roller 11 is disposed on the outside of the rotational path of fixing belt 101 and presses fixing roller 10 from the outside of fixing belt 101 with fixing belt 101 interposed, thereby to ensure fixing nip region n2 between the surface of pressing roller 11 and fixing belt 101.

Core metal 131 is made of aluminum or the like. Elastic layer 132 is formed of silicone rubber sponge or the like. Release layer 133 is, for example, a PFA (tetrafluoroethylene-perfluoroalkyl vinylether copolymer) or PTFE (polytetrafluoroethylene) coat. The outer diameter of pressing roller 11 is about 35 mm.

Fixing roller 10 and pressing roller 11 are rotatably supported at the opposite ends in the axial direction of core metals 121 and 131, respectively, by not-shown frames, for example, with bearing members. Pressing roller 11 is rotatably driven in the direction of an arrow B shown in FIG. 2 by a driving force transmitted from a drive motor (not shown). With the rotation of pressing roller 11, fixing belt 101 and fixing roller 10 are driven to rotate in the direction of the arrow A.

(Magnetic Flux Generator 12)

Figure 4:
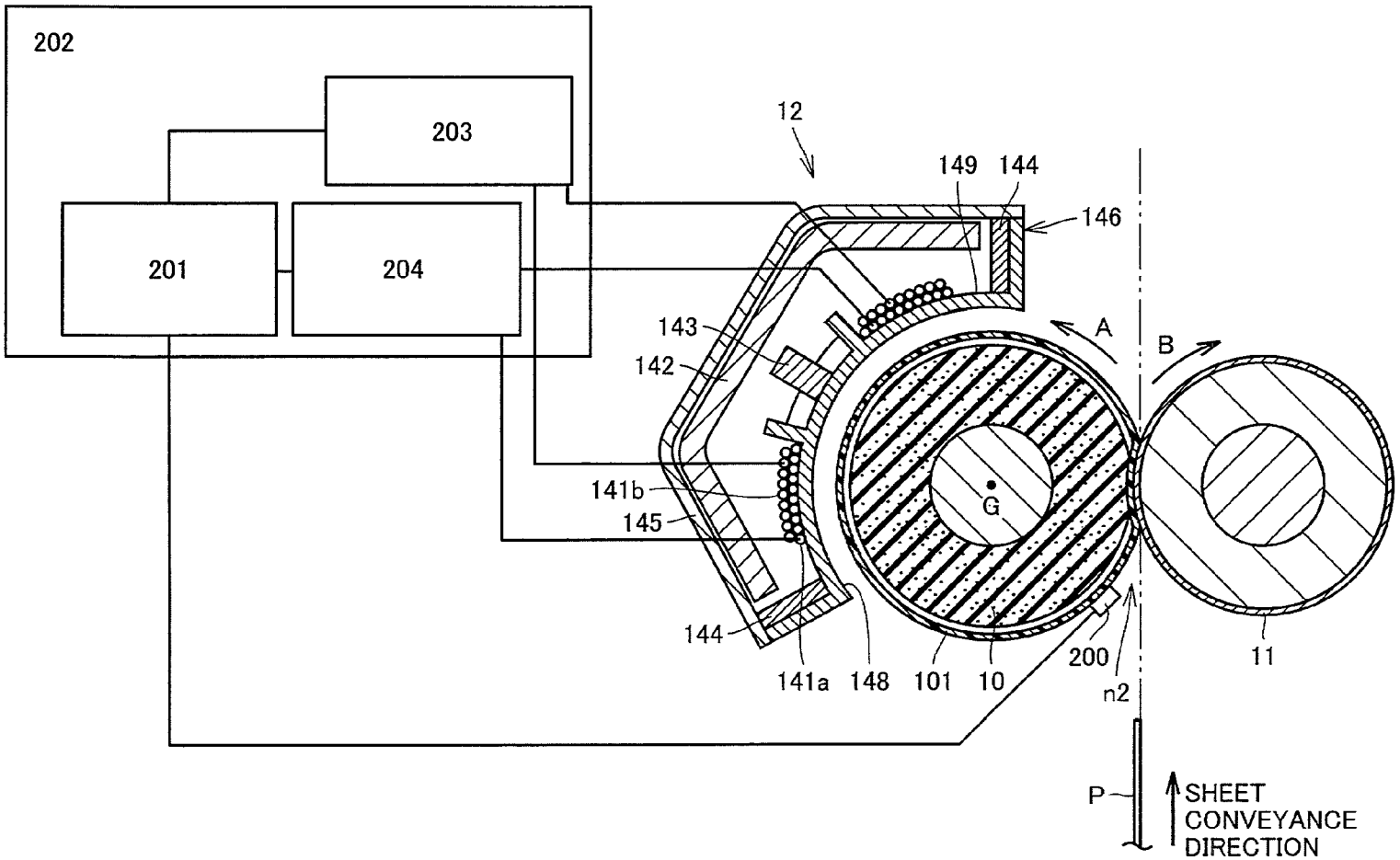
FIG. 4 is a cross-sectional view as viewed from the direction of a line IV-IV in FIG. 2.

FIG. 4 shows a cross-sectional view as viewed from the direction of a line Iv-Iv in FIG. 2. Referring to FIG. 2 and FIG. 4, magnetic flux generator 12 includes an exciting coil 141*a*, a demagnetizing coil 141*b*, main cores 142, center cores 143, hem cores 144, a cover 145, and a coil bobbin 146. Main cores 142, center cores 143, and hem cores 144 are fixed on a back surface 149 of coil bobbin 146 on the side opposite to fixing belt 101.

Magnetic flux generator 12 is arranged along the width direction of fixing belt 101 at a position opposed to pressing roller 11 with fixing belt 101 interposed on the outside of the rotational path of fixing belt 101.

Coil bobbin 146 is a plate-like member curved in an arc shape along the rotational direction of fixing belt 101 (hereinafter referred to as "belt rotational direction"). The opposite ends of coil bobbin 146 in the belt width direction are fixed to a not-shown frame or the like. A high heat-resistant insulating resin material is used for coil bobbin 146. For example, in order to alleviate a warp caused by heat when coil bobbin 146 reaches a fixing temperature, LCP (Liquid Crystal Polymer) may be adopted for coil bobbin 146.

Exciting coil 141*a* and demagnetizing coil 141*b* are structured such that lead wires are wound along the longitudinal direction (the direction orthogonal to the rotating and moving direction) of fixing roller 10. Exciting coil 141*a* and demagnetizing coil 141*b* are fixed to coil bobbin 146.

Exciting coil 141*a* is connected to a high frequency power supply circuit 202 to be supplied with high frequency power of 10 kHz to 100 kHz and 100 W to 2000 W. Litz wire consisting of a few tens to a few hundreds of fine wires coated with heat-resistant resin is used for exciting coil 141*a*. Demagnetizing coil 141*b* is wound along the longitudinal direction of exciting coil 141*a*. Litz wire is also used for demagnetizing coil 141*b*.

Main cores 142 each having a trapezoid cross section are arranged with a prescribed gap therebetween in the axial direction to cover the outer surface of exciting coil 141*a*. Several to a dozen or so main cores 142 may be arranged. Hem cores 144 may be either integral or split. In the present embodiment, a plurality of hem cores 144 are arranged with no gap.

Center cores 143 increase magnetic coupling at opposite ends of fixing roller 10 as viewed from the axial direction in order to compensate for heat dissipation from the end portions of fixing roller 10. A plurality of center cores 143 are arranged with no gap in the axial direction of fixing roller 10.

Main cores 142 and hem cores 144 are magnetic cores for increasing the efficiency of a magnetic circuit between exciting coil 141*a* and heat generation layer 113 of fixing belt 101 and blocking leakage of a magnetic flux to the outside. A material with a high magnetic permeability and a low loss is used for the magnetic core. Alloys such as ferrite and permalloy are preferably used.

(Control)

Temperature control of fixing belt 101 is performed by a control circuit 201. A temperature sensor 200 is disposed in the vicinity of fixing nip region n2. Temperature sensor 200 is, for example, a contactless infrared sensor. A surface temperature detection signal of fixing belt 101 by temperature sensor 200 is input to control circuit 201.

Control circuit 201 controls high frequency power supply circuit 202 based on the surface temperature detection signal of the fixing belt 101 that is input from temperature sensor 200. Power supply from high frequency power supply circuit 202 to magnetic flux generator 102 is increased/decreased so that the surface temperature of fixing belt 101 is automatically controlled at a prescribed fixed temperature.

Specifically, control circuit 201 switches an exciting coil switching relay 203 and a demagnetizing coil switching relay 204 in high frequency power supply circuit 202, thereby performing temperature control of fixing belt 101.

Exciting coil 141*a* is arranged on the back surface 149 of coil bobbin 146 and is connected to high frequency power supply circuit 202. Supply of AC power from high frequency power supply circuit 202 generates a magnetic flux for heating the heat generation layer 113 of fixing belt 101. The magnetic flux generated from exciting coil 141*a* is guided from main cores 142 to fixing belt 101 through hem cores 144 and mainly passes through a portion of heat generation layer 113 of fixing belt 101 that is opposed to magnetic flux generator 12. Eddy current is then generated at this portion of heat generation layer 113, thereby allowing heat generation layer 113 to generate heat per se.

With fixing belt 101 being driven to rotate, the heat from the heating portion is transmitted to pressing roller 11 and the like at the location of fixing nip region n2. The temperature thus rises at the area of fixing nip region n2. The temperature of fixing belt 101 at present is detected by the detection signal of temperature sensor 200 for detecting the temperature of fixing belt 101. Based on the detected temperature, power supply to exciting coil 141*a* is controlled such that the temperature of the area of fixing nip region n2 is maintained at a target temperature.

When paper P passes through fixing nip region n2 with the area of fixing nip region n2 maintained at the target temperature, the unfixed toner image on paper P is heated and pressed, thereby being thermally fixed on paper P.

Figure 5:
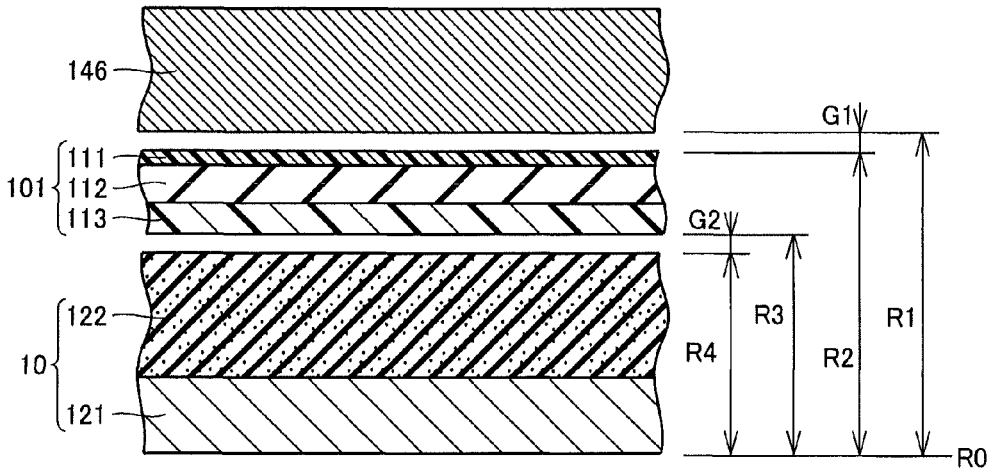
FIG. 5 is a cross-sectional view showing an arrangement of a coil bobbin, the fixing belt, and the fixing roller of the fixing device in the embodiment.

Referring to FIG. 5, the positional relation between coil bobbin 146, fixing belt 101, and fixing roller 10 is shown. With the axial center R0 of fixing roller 10 as a reference, the rotation distance radius of each of the shown members is represented by R (mm). The distance from the axial center R0 to the inner diameter (the side opposed to the belt) of coil bobbin 146 is R1 (mm). The distance from the axial center R0 to the outer diameter (the side opposed to the coil bobbin) of fixing belt 101 is R2. The distance from the axial center R0 to the inner diameter (the side opposed to the fixing roller) of fixing belt 101 is R3. The distance from the axial center R0 to the outer diameter (the side opposed to the belt) of fixing roller 10 is R4.

There is a gap G1 between the distance R1 (mm) to the inner diameter (the side opposed to the belt) of coil bobbin 146 and the distance R2 to the outer diameter (the side opposed to the coil bobbin) of fixing belt 101. For example, the gap G1 is set to 1.5 mm so that high magnetic coupling is maintained between magnetic flux generator 12 and heat generation layer 113 of fixing belt 101. The magnetic coupling reduces and the heat generation efficiency decreases as the gap G1 increases.

Fixing roller 10 is inserted in fixing belt 101. Fixing roller 10 and fixing belt 101 are not adhered to each other. There is a gap G2 between the distance R3 from the axial center R0 to the inner diameter (the side opposed to the fixing roller) of fixing belt 101 and the distance R4 from the axial center R0 to the outer diameter (the side opposed to the belt) of fixing roller 10. The gap G2 is set, for example, to 0.3 mm.

As the gap G2 increases, the vibration of fixing belt 101 increases during rotation of fixing roller 10, and fixing belt 101 is more likely to come into contact with coil bobbin 146. In a case where heat insulation layer 122 of fixing roller 10 is formed of silicone sponge rubber or the like, the vibration of fixing belt 101 can be reduced by inserting the frozen silicone sponge rubber in fixing belt 101 or by adhering fixing belt 101 and fixing roller 10 together. However, the manufacturing cost is increased.

Then, in the present embodiment, the gap G2 is set to about 0.1 mm to 0.55 mm in order to facilitate insertion of fixing roller 10 into fixing belt 101 with a reduced size of the gap G2.

(Detailed Structure of Coil Bobbin 146)

Referring now to FIG. 6 to FIG. 10, a detailed structure of coil bobbin 146 in the present embodiment will be described. A fixing belt movement restricting member is provided in a non-paper-passage region L2 in order that fixing belt 101 should not come into contact with coil bobbin 146 in a paper-passage region L1.

To ensure a relative positional accuracy between the fixing belt movement restricting member and coil bobbin 146, it is desired that the fixing belt movement restricting member should be installed on coil bobbin 146 and should have a function of assisting in durability without active abutment, considering that the thermal capacity of fixing belt 101 should not be increased.

Figure 6:
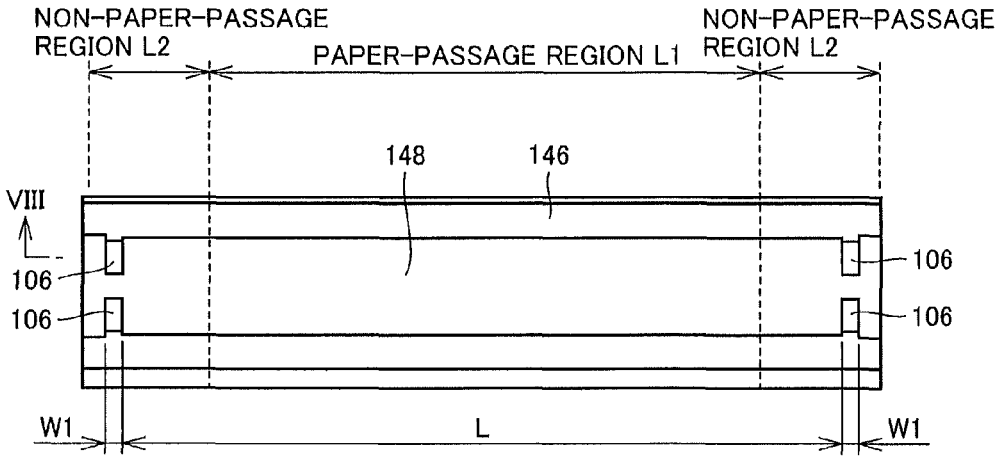
FIG. 6 is a front view solely showing the coil bobbin in the embodiment.
Figure 7:
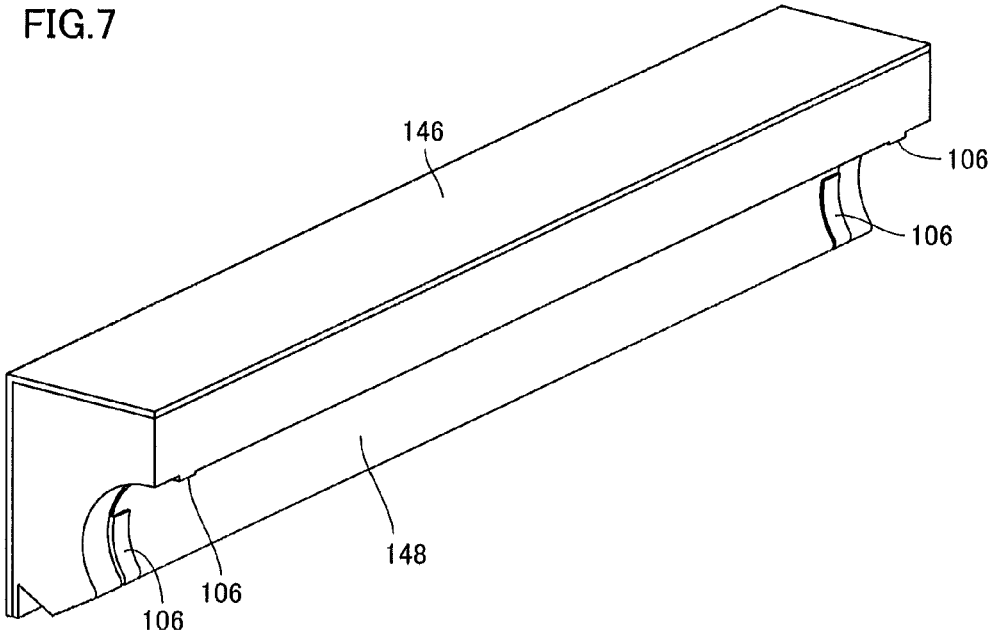
FIG. 7 is a perspective view of the coil bobbin in the embodiment.
Figure 8:
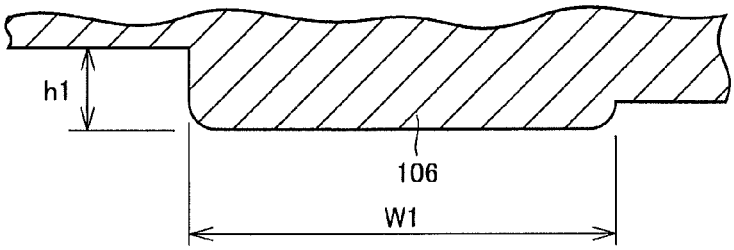
FIG. 8 is a cross-sectional view of a convex portion provided in the coil bobbin in the embodiment.

Referring to FIG. 6 to FIG. 8, a detailed structure of coil bobbin 146 will be described. Coil bobbin 146 in the present embodiment has a curved opposing surface 148 extending in the axial direction on the side facing fixing belt 101. The image effective width (paper-passage region L1) of coil bobbin 146 is 305 mm. Fixing belt movement restricting members 106 having a convex shape are provided between the widths of 320 mm and 325 mm (outer sides: non-paper-passage regions L2) on opposite sides of the image effective width (paper-passage region L1). As paper P, the width of A4 sheet is 297 mm, which is within the range of the width of the paper-passage region L1.

As shown in FIG. 6 to FIG. 10, fixing belt movement restricting members 106 are provided at two points on the circumference along the curved surface of opposing surface 148. The circumferential length of one fixing belt movement restricting member 106 is about 20 mm. The distance (L) between fixing belt movement restricting members 106 located on opposite ends is about 320 mm. The width (W1) of fixing belt movement restricting member 106 is about 5 mm. The height (h1) of fixing belt movement restricting member 106 from opposing surface 148 of coil bobbin 146 is 0.5 mm. Fixing belt movement restricting members 106 are provided at two points on the circumference, although they may be integrated or may be split into three or more.

Because of the provision of fixing belt movement restricting members 106, the gap G1 (see FIG. 5) between fixing belt 101 and coil bobbin 146 is 1.5 mm in the image effective width (paper-passage region L1), whereas the gap G1 between fixing belt 101 and coil bobbin 146 is 1.0 mm in the non-paper-passage region L2 provided with fixing belt movement restricting members 106.

The height (h1) of fixing belt movement restricting member 106 is preferably about 0.5 mm because as the height increases, the friction force against fixing belt 101 increases when fixing belt movement restricting member 106 comes into abutment with fixing belt 101. The width (W1) of fixing belt movement restricting member 106 is preferably about 5 mm to 15 mm because the movement restricting force of fixing belt movement restricting member 106 becomes weak as the width decreases, and the friction force against fixing belt 101 increases as the width increases.

Figure 9:
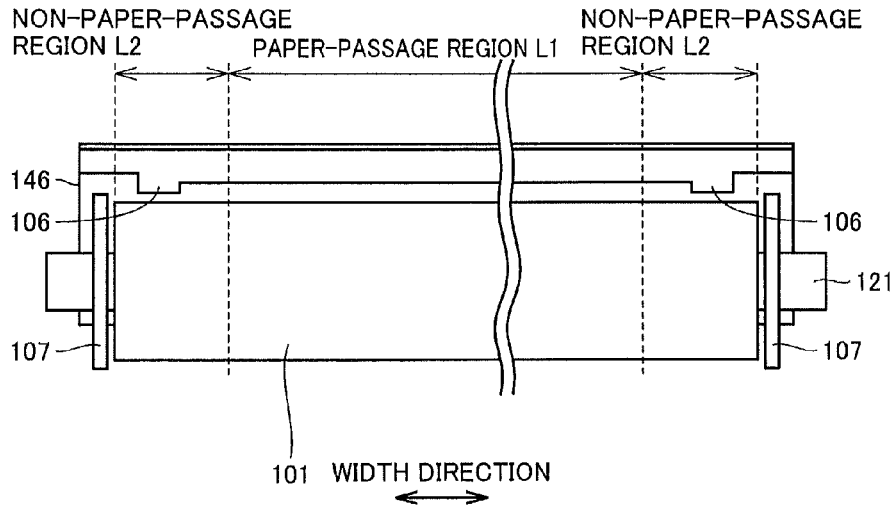
FIG. 9 shows a normal state in a state in which the fixing roller and the fixing belt are attached to the coil bobbin in the embodiment.
Figure 10:
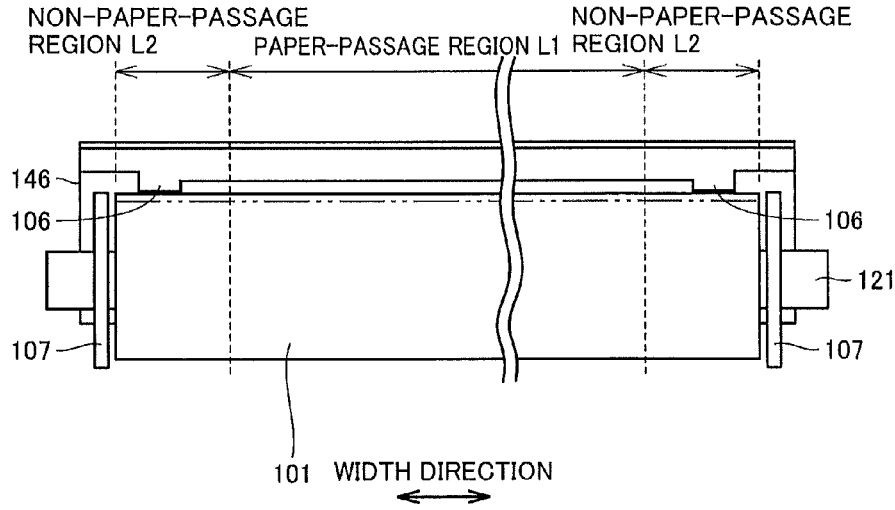
FIG. 10 shows a state in which a fixing belt movement restricting member functions in the state in which the fixing roller and the fixing belt are attached to the coil bobbin in the embodiment.

FIG. 9 shows a state in which no vibration occurs in fixing belt 101. A gap is formed between fixing belt movement restricting members 106 and fixing belt 101. FIG. 10 shows a state in which vibration occurs in fixing belt 101. In the non-paper-passage region L2, fixing belt 101 abuts on fixing belt movement restricting members 106. The vibration of fixing belt 101 is thus suppressed. In the paper-passage region L1, fixing belt 101 does not abut on opposing surface 148 of coil bobbin 146.

Figure 11:
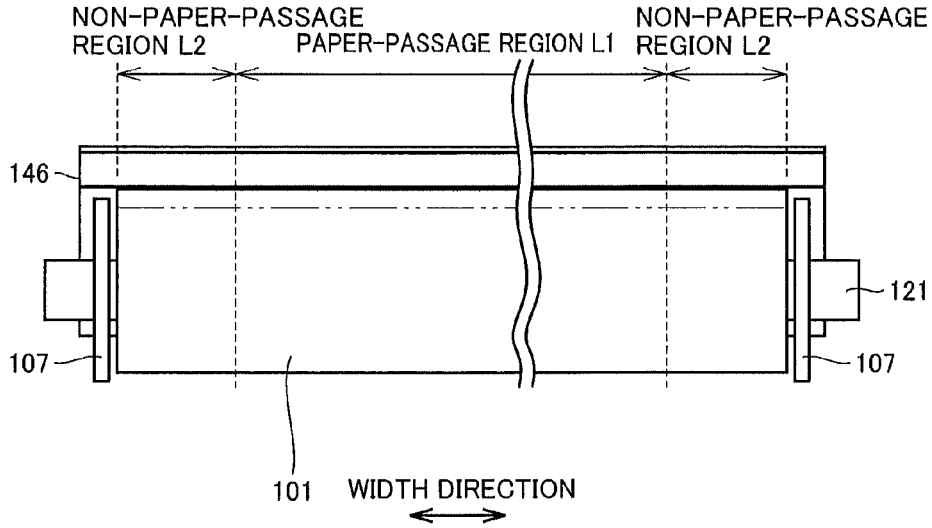
FIG. 11 shows a state in which the fixing belt is in abutment with the coil bobbin without provision of the fixing belt movement restricting member.
Figure 12:
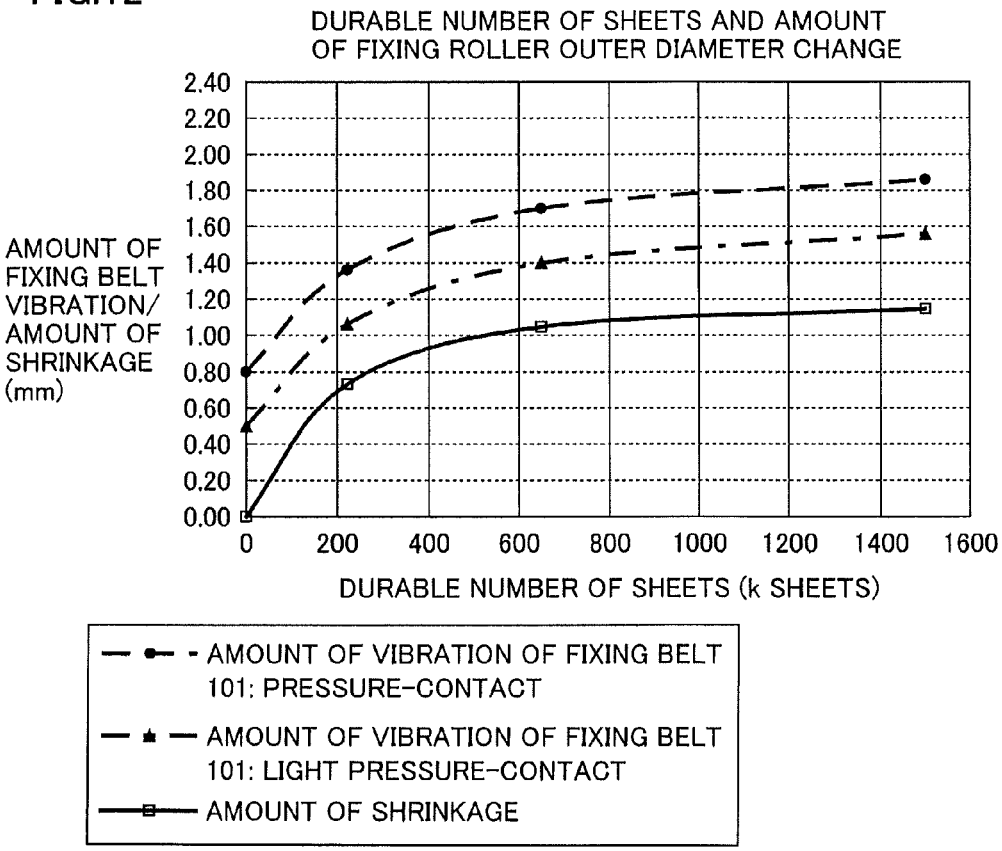
FIG. 12 is a graph showing the relation between the durable number of sheets and the amount of fixing belt vibration and the amount of shrinkage.

Here, FIG. 11 shows a state in which fixing belt 101 abuts on coil bobbin 146 without provision of the fixing belt movement restricting members. FIG. 12 shows the relation between the durable number of sheets and the amount of fixing belt vibration and the amount of shrinkage.

As shown in FIG. 12, as the durable number of sheets (the number of sheets being passed: K represents×1000 sheets) increases, the amount of shrinkage of fixing roller 10 increases (the outer diameter reduces), and the amount of vibration of fixing belt 101 increases at the same time. The amount of vibration of fixing roller 10 is greater in a pressure-contact mode with a greater pressure-contact force (normal paper fixing pressure-contact) than in a light pressure-contact (envelope fixing pressure) mode.

In the endurance test, initially, the vibration during rotation of fixing belt 101 is smaller than the gap G1 of 1.5 mm, and fixing belt 101 does not come into contact with opposing surface 148 of coil bobbin 146. However, after 1200K sheets (where K represents×1000 sheets) of paper are passed, the outer shape of fixing roller 10 is shrunken due to thermal degradation, and the vibration of fixing belt 101 increases at the same time. As a result, fixing belt 101 becomes oval according to the curvature of fixing nip region n2. One of the factors of the increased vibration of fixing belt 101 may be that the rubber hardness of fixing roller 10 reduces and the width of fixing nip region n2 increases.

Therefore, in both of the light pressure-contact (envelope fixing pressure) mode and the pressure-contact (normal paper fixing pressure-contact) mode, the vibration during rotation of fixing belt 101 becomes greater than the gap G1 of 1.5 mm, and as shown in FIG. 11, fixing belt 101 comes into contact with opposing surface 148 of coil bobbin 146. As a result, fine scratches are made on the surface of fixing belt 101, and scratch marks are transferred onto images when toner is fixed on paper.

Offset toner or paper dust from fixing belt 101 gathered and adhered on coil bobbin 146 from fixing belt 101 is also one of the factors of scratches on fixing belt 101.

On the other hand, as shown in the present embodiment, the provision of fixing belt movement restricting members 106 on opposing surface 148 of coil bobbin 146 in non-paper-passage region L2 prevents contact of coil bobbin 146 with fixing belt 101 in the paper-passage region L1.

Example

The endurance evaluation of fixing belt 101 under friction between fixing belt 101 and fixing belt movement restricting members 106 was carried out. FIG. 13 shows the evaluation results of contact endurance of fixing belt 101. The vibration of fixing roller 10 is greatest at the room temperature, and the vibration reduces when fixing roller 10 becomes warm. Thus, as the evaluation conditions, it is assumed that fixing device 20 has its temperature increased from the room temperature twice a day. The number of times 3000 calculated based on the equation below was used as the criterion. The fixing roller 10 in which the amount of shrinkage was saturated was produced, and the endurance evaluation of fixing belt 101 was carried out.

Fixing belt 101 used had a 40 μm Ni substrate as heat generation layer 113, an Si rubber layer as elastic layer 112, and a PFA tube layer as release layer 111. Fixing belt movement restricting members 106 integrally molded with coil bobbin 146 as shown in FIG. 6 to FIG. 8 were provided on opposing surface 148 of coil bobbin 146. The width (W) of fixing belt movement restricting member 106 was 7 mm, and the material thereof was LCP (Liquid Crystal Polymer).

Considering the usage in general office environments, the number of times of contact between fixing belt 101 and coil bobbin 146 was calculated as follows.

(Number of Times of Contact)

Fixing driven from the room temperature: twice 1 day×operation days per month (20 days)×months of a year (12 months)×years (5 years)×margin (1.25)

twice×20 days x×12 months×5 years×1.25=3000

The surface layer abrasion of fixing belt 101 was evaluated assuming that the number of times of contact between fixing belt 101 and coil bobbin 146 was 3000.

The light pressure-contact mode (envelope fixing pressure) and the contact-pressure mode (normal paper fixing pressure) were used as the modes of pressing between fixing roller 10 and the pressing roller. The highest rotational speed of the fixing roller was 325 mm/s, and 20 rotations were assumed as one count.

The material of fixing belt movement restricting member 106 was LCP (Polyplastics Co., Ltd., VECTRA® S471; heat resistance 240° C.; material A in FIG. 13). In addition, a fluorine tape (Teflon®: NITOFLON® adhesive tape No. 903UL; heat resistance 180° C.; material B in FIG. 13) and PFA (Teflon®; NITOFLON adhesive tape No. 903UL; heat resistance 260° C.; material C in FIG. 13) were each adhered to fixing belt movement restricting member 106. For each case, the endurance at 3000 times was evaluated.

As a result, evaluation "B" was obtained in the case of using material A, and evaluation "A" was obtained in the cases of using material B and material C. Good evaluation was obtained in materials A, B, and C. Evaluation "A" represents such a level in that almost no abrasion occurs only with slight gloss variations. Evaluation "B" represents such a level in that minute abrasion occurs.

In the evaluations described above, material B and material C were affixed as fluorine-based members having a friction coefficient smaller than that of fixing belt movement restricting member 106, in a region of fixing belt movement restricting member 106 that is opposed to fixing belt 101. However, any other material having the same property may be applied.

The traces of rubbing against fixing belt 101 were fewest when the fluorine-based material was used at the contact portion with fixing belt 101. However, even when the same LCP as coil bobbin 146 was used, abrasion occurred only to the same degree as traces of rubbing against paper edges.

In view of costs, it is cheapest to produce the convex shape of fixing belt movement restricting member 106 simultaneously using a mold die of coil bobbin 146. The surface planarity of LCP is relatively good, and the heat resistance thereof is also excellent.

In order to further increase the lifetime of fixing belt 101, the surface layer of fixing belt movement restricting member 106 may be coated with fluorine, or a fluorine tape may be affixed, or a PFA resin member may be adhered or fixed. Fixing belt movement restricting member 106 may be provided with a roller having a rotating function (rotating member) to perform a function of swinging the relative position between fixing belt 101 and coil bobbin 146 in the axial direction.

As the final confirmation after the evaluations above, the endurance evaluation in the actual apparatus was conducted with LCP fixing belt movement restricting members 106 provided on coil bobbin 146. No failure in fixing device 20 nor image quality problem in image forming apparatus 100 was observed even after 1200K sheets of paper were passed.

As described above in the present embodiment, the provision of the restricting member, that is, fixing belt movement restricting members 106 on coil bobbin 146 prevents contact between fixing belt 101 and coil bobbin 146 in paper-passage region L1 (image guaranteed region) even when the silicone sponge of fixing roller 10 is shrunken. Thus, damages to fixing belt 101 resulting from adherents on coil bobbin 146 can be prevented, and the durability of fixing belt 101 can be improved.

Accordingly, the durability of fixing device 20 can be improved without a cost increase while keeping the energy-saving configuration of fixing device 20. Image forming apparatus 100 with stable image quality can be implemented.

The fixing device and the image forming apparatus having a configuration capable of preventing damages to the fixing belt can be provided without reducing the heat generation efficiency in induction heating.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing device comprising:

a fixing belt being driven to rotate and having a heat generation layer generating heat by induction heating;

a fixing roller arranged inside said fixing belt so that the entire inner circumference of the fixing belt is exposed to the fixing roller, and the fixing roller being the only roller inside the fixing belt;

a pressing roller for pressing said fixing belt together with said fixing roller to form a fixing nip region for fixing an unfixed toner image on a sheet passing therethrough; and a magnetic flux generator including a coil for generating a magnetic flux to be passed through said heat generation layer of said fixing belt, and a holding member arranged to be opposed to said fixing belt for holding said coil, wherein said fixing nip region includes a paper-passage region allowing said sheet to pass through, and a non-paper-passage region located on opposite sides of said paper-passage region and not allowing said sheet to pass through, a fixing belt movement restricting member arranged at a prescribed distance away from said fixing belt is provided in said non-paper-passage region of said holding member such that in a normal state a gap is provided between the outer circumferential surface of the fixing belt and the fixing belt movement restricting member so that the fixing belt does not come into contact with the fixing belt movement restricting member, and in a state in which the fixing roller is shrunk and vibration of the fixing belt increases, the fixing belt comes into contact with the fixing belt movement restricting member, and even when said fixing belt comes into abutment with said fixing belt movement restricting member, a prescribed space is formed between said fixing belt and a surface of said holding member that is opposed to said fixing belt, in said paper-passage region.

2. The fixing device according to claim 1, wherein said fixing belt movement restricting member is a convex portion extending from the surface of said holding member that is opposed to said fixing belt toward said fixing belt.

3. The fixing device according to claim 2, wherein said fixing belt movement restricting member is integrally molded with said holding member.

4. The fixing device according to claim 3, wherein said holding member and said fixing belt movement restricting member are formed of heat-resistant insulating resin.

5. The fixing device according to claim 3, wherein a region in which a coefficient of friction against said fixing belt is lower than a portion of said fixing belt movement restricting member that is integrally formed with said holding member is provided in a region of said fixing belt movement restricting member that is opposed to said fixing belt.

6. An image forming apparatus having a fixing device, said fixing device including a fixing belt being driven to rotate and having a heat generation layer generating heat, a fixing roller arranged inside said fixing belt so that the entire inner circumference of the fixing belt is exposed to the fixing roller, and the fixing roller being the only roller inside the fixing belt, a pressing roller for pressing said fixing belt together with said fixing roller to form a fixing nip region for fixing an unfixed toner image on a sheet passing therethrough, and a magnetic flux generator including a coil for generating a magnetic flux to be passed through said heat generation layer of said fixing belt, and a holding member arranged to be opposed to said fixing belt for holding said coil, wherein said fixing nip region includes a paper-passage region allowing said sheet to pass through, and a non-paper-passage region located on opposite sides of said paper-passage region and not allowing said sheet to pass through, a fixing belt movement restricting member arranged at a prescribed distance away from said fixing belt is provided in said non-paper-passage region of said holding member such that in an initial state a gap is provided between the outer circumferential surface of the fixing belt and the fixing belt movement restricting member so that the fixing belt does not come into contact with the fixing belt movement restricting member, and in a state in which the fixing roller shrinks and vibration of the fixing belt increases, the fixing belt comes into contact with the fixing belt movement restricting member, and even when said fixing belt comes into abutment with said fixing belt movement restricting member, a prescribed space is formed between said fixing belt and a surface of said holding member that is opposed to said fixing belt, in said paper-passage region.

7. The image forming apparatus according to claim 6, wherein said fixing belt movement restricting member is a convex portion extending from the surface of said holding member that is opposed to said fixing belt toward said fixing belt.

8. The image forming apparatus according to claim 7, wherein said fixing belt movement restricting member is integrally molded with said holding member.

9. The image forming apparatus according to claim 8, wherein said holding member and said fixing belt movement restricting member are formed of heat-resistant insulating resin.

10. The image forming apparatus according to claim 8, wherein a region in which a coefficient of friction against said fixing belt is lower than a portion of said fixing belt movement restricting member that is integrally formed with said holding member is provided in a region of said fixing belt movement restricting member that is opposed to said fixing belt.

11. The fixing device according to claim 1, wherein the state in which the fixing roller is shrunk is during a period when a temperature of the fixing device is being increased from room temperature to a fixing temperature and the fixing belt comes into contact with the fixing belt movement restricting member while the fixing belt is rotating, and the normal state is when the temperature of the fixing device reaches the fixing temperature, and the fixing belt does not come into contact with the fixing belt movement restricting member.

12. The image forming apparatus according to claim 6, wherein the state in which the fixing roller is shrunk is during a period when a temperature of the fixing device is being increased from room temperature to a fixing temperature and the fixing belt comes into contact with the fixing belt movement restricting member while the fixing belt is rotating, and the normal state is when the temperature of the fixing device reaches the fixing temperature, and the fixing belt does not come into contact with the fixing belt movement restricting member.

* * * * *